United States Patent [19]

Pawlak

[11] Patent Number: 4,717,272

[45] Date of Patent: Jan. 5, 1988

[54] RIBBON FEED MECHANISM

[75] Inventor: Stephen M. Pawlak, Homer, N.Y.

[73] Assignee: Smith Corona Corporation, Cortand, N.Y.

[21] Appl. No.: 7,142

[22] Filed: Jan. 27, 1987

Related U.S. Application Data

[63] Continuation of Ser. No. 769,217, Aug. 26, 1985, abandoned.

[51] Int. Cl.[4] ..... B41J 33/39

[52] U.S. Cl. ..... 400/232; 400/218; 400/225; 242/219

[58] Field of Search ..... 400/221, 225, 226, 231, 400/232, 240.1, 568, 218; 242/77, 219, 218

[56] References Cited

U.S. PATENT DOCUMENTS

| | | | |
|---|---|---|---|
| 3,346,090 | 10/1967 | Goff, Jr. et al. | 400/232 X |
| 3,481,446 | 12/1969 | Burkhardt et al. | 400/218 |
| 3,643,729 | 2/1972 | Anderson et al. | 400/232 X |
| 4,131,374 | 12/1978 | Porterfield | 400/232 |
| 4,365,904 | 12/1982 | Mueller et al. | 400/568 |
| 4,395,149 | 7/1978 | Longrod | 400/232 X |
| 4,611,938 | 9/1986 | Rettke et al. | 400/225 X |
| 4,613,248 | 9/1986 | Iwase et al. | 400/240.1 |

FOREIGN PATENT DOCUMENTS

| | | | |
|---|---|---|---|
| 65584 | 5/1980 | Japan | 400/568 |
| 70686 | 5/1982 | Japan | 400/221 |
| 67494 | 4/1983 | Japan | 400/226 |
| 7081 | 1/1984 | Japan | 400/232 |

*Primary Examiner*—Edgar S. Burr
*Assistant Examiner*—James R. McDaniel
*Attorney, Agent, or Firm*—Kenneth W. Greb

[57] ABSTRACT

A ribbon feed mechanism for printing machines has a motor coupled to a ribbon drive mechanism for feeding a ribbon in response to energization of the motor. A control mechanism is coupled to the ribbon drive mechanism and responsive to the ribbon drive mechanism during ribbon feeding for limiting the amount of ribbon feed to predetermined feed increments.

3 Claims, 4 Drawing Figures

RIBBON FEED MECHANISM

This is a continuation of application Ser. No. 769,217, filed Aug. 26, 1985, now abandoned.

BACKGROUND OF THE INVENTION

The present invention relates to a ribbon feed mechanism for printing machines and more particularly relates to a control mechanism for incrementally feeding a print ribbon in a ribbon cassette.

A known ribbon feed mechanism has a motor coupled to a ribbon drive mechanism by a slip clutch for advancing a print ribbon from a supply spool to a take-up spool. A control mechanism including a stepping magnet is connected to the print ribbon for limiting the amount of ribbon feed to predetermined feed increments. This ribbon feed mechanism is disclosed in U.S. Pat. No. 3,481,446 issued on Dec. 2, 1969 and invented by Gisbert Burkhardt et al.

A disadvantage of this ribbon feed mechanism is having a stepping magnet and having a means for selectively energizing the stepping magnet in addition to the motor for advancing the ribbon results in excessive manufacturing costs.

A known linespacing mechanism has a D.C. motor coupled to a drive member which includes a cam profile having a cam surface and an abutment. The linespacing mechanism has a cam follower for following the cam surface to provide a power source for actuating linespacing increments. The cam follower also contacts the abutment for stopping the drive mechanism. This linespacing mechanism is disclosed in U.S. Pat. No. 4,365,904 issued on Dec. 28, 1982 and invented by Hans W. Mueller et al.

A disadvantage of this linespacing mechanism is having the cam follower provide the power source for actuating the linespacing requires additional linkage compared to the present invention which results in excessive manufacturing costs.

SUMMARY OF THE INVENTION

A ribbon feed mechanism for printing machines has a D.C. motor coupled to a wheel for incrementally rotating the wheel. A drive shaft is rigidly connected to the wheel for rotation therewith. The drive shaft engages a drive member in a ribbon cartridge for feeding a print ribbon mounted in the cartridge in response to energization of the stepper motor. A toothed shaped cam profile is formed in the wheel. A control mechanism includes a cam follower mounted on a pivotable arm actuated by the cam profile in response to rotation of the wheel for limiting the amount of rotation of the wheel to limit the amount of ribbon feed to predetermined feed increments.

Accordingly an object of this invention is to provide a low manufacturing cost and an efficient ribbon feed mechanism by combining an economical control mechanism and a D.C. motor for limiting the amount of ribbon feed to predetermined feed increments.

Other objects, features and advantages of the invention will become more apparent from the following description, including appended claims and accompanying drawing.

DESCRIPTION OF THE PREFERRED EMBODIMENT

Figure 1:
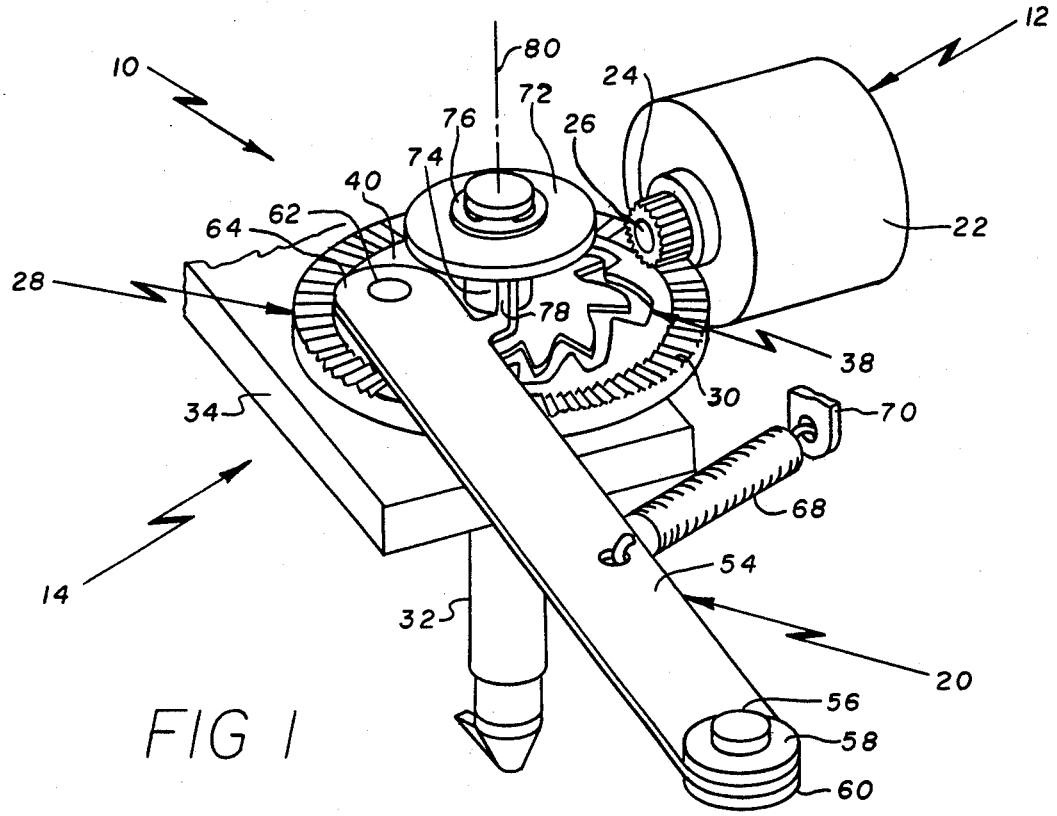
FIG. 1 is a bottom perspective view of a ribbon feed mechanism made in accordance with the present invention.
Figure 4:
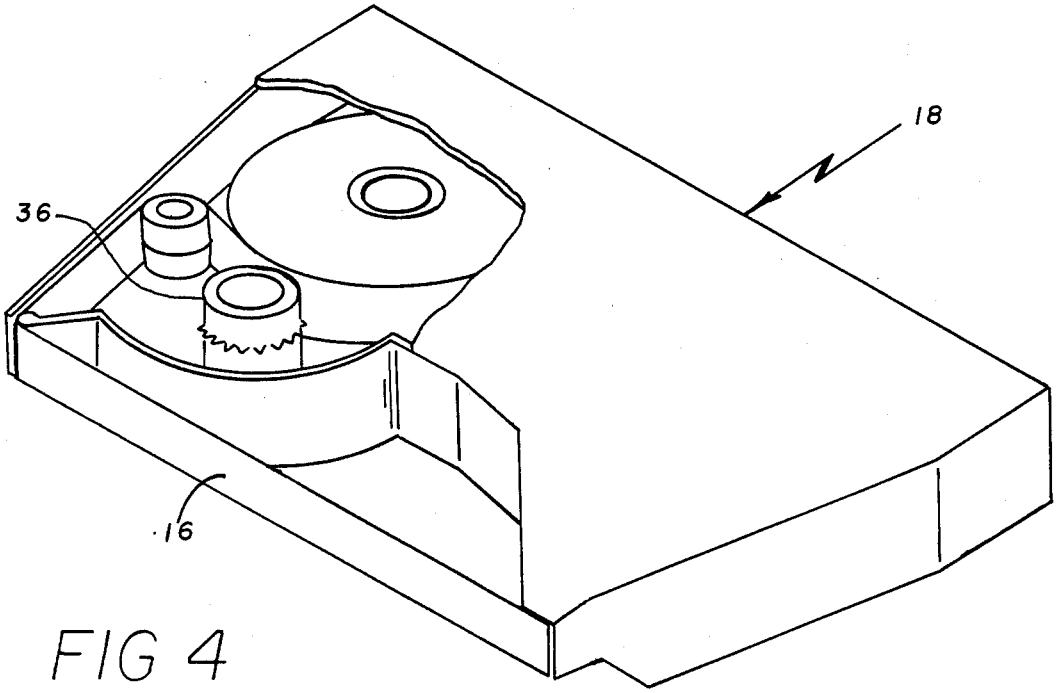
FIG. 4 is a top perspective view of a ribbon cartridge carrying a supply of a print ribbon for incremental feeding by the ribbon feed mechanism.

Referring to FIG. 1, a ribbon feed mechanism 10 for printing machines consists of a power source 12 coupled to a drive means 14 for feeding a print ribbon 16 carried in ribbon cartridge 18 (FIG. 4). A control means 20 is coupled to the drive means 14 for limiting the amount of ribbon feed to predetermined feed increments.

The power source 12 includes a D.C. motor 22 and a pinion gear 24 mounted on a shaft 26 of the D.C. motor 22.

The drive means 14 includes a wheel 28 which has gear teeth 30 integrally formed around a periphery thereof. The gear teeth 30 are in mesh with the pinion gear 24 for coupling the drive means 14 to the power source 12. A drive shaft 32 is supported on a frame 34 for rotation relative thereto. The wheel 28 is rigidly assembled to the drive shaft 32 for rotation therewith. When the ribbon cartridge 18 is inserted into the printing machine, the drive shaft 32 engages a drive member 36 in the ribbon cartridge 18 (FIG. 4) for feeding the print ribbon 16. A cam profile 38 is integrally formed in a face 40 of the wheel 28. The cam profile 38 includes an outwardly projecting tooth 42 (FIG. 2), which has a first working cam surface 44 and a second working surface 46. The cam profile 38 also includes an inwardly projecting tooth 48, which has a non-working surface 50 and an abutment 52. The cam profile 38 forms a circular path made up of a plurality of the teeth 42 and 48 and arranged parallel to and with a smaller diameter than the gear teeth 30 of the wheel 28.

Figure 2:
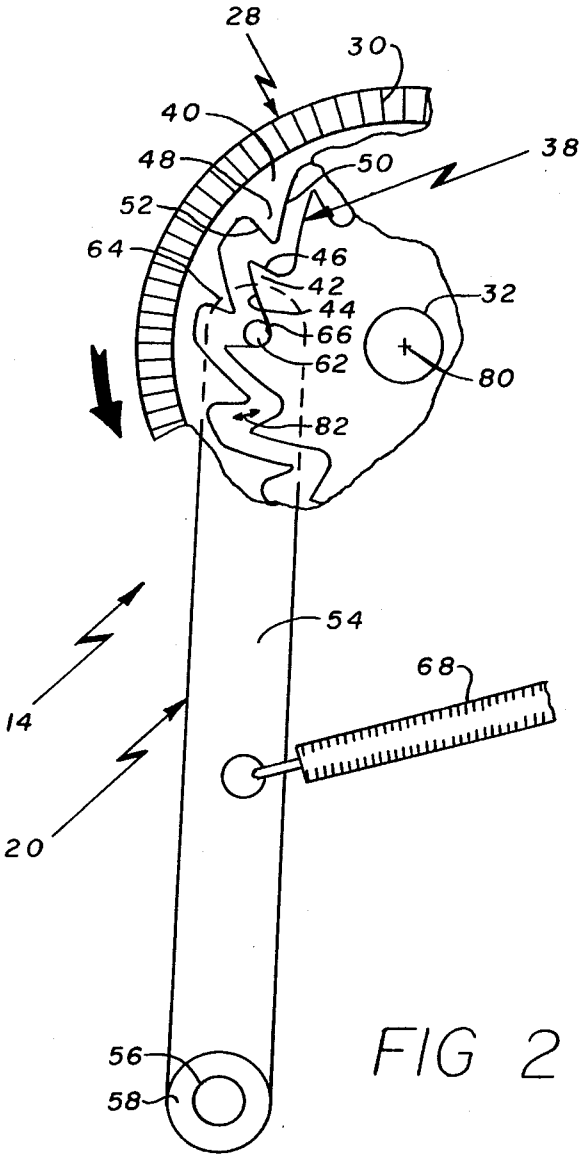
FIG. 2 is an enlarged bottom, partial, plan view of a control mechanism portion of the ribbon feed mechanism showing a cam follower in a rest position.

The control means 20 includes an arm 54 pivotably mounted on a post 56 between two rubber washers 58 and 60 (FIG. 1). A cam follower 62 is rigidly attached to a free end 64 of the arm 54. The cam follower 62 is seated in the cam profile 38 at an inoperative or rest position 66 (FIG. 2). A spring 68 connected between the arm 54 and a rigid spring anchor 70 biases the arm 54 clockwise about the post 56. The cam follower 62 is biased in the rest position 66 by the spring 68. A disc 72 (FIG. 1) is mounted on a hub 74 integrally formed with the wheel 28 by a c-ring 76. A finger 78 is integrally formed from the arm 54 to abut against the disc 72 for holding the cam follower 62 seated in the cam profile 38.

A ribbon feed operation will now be described. When a single printing operation is actuated in the printing machine, the D.C. motor 22 is energized for a sufficient length of time (38 milliseconds) to rotate the pinion gear 24 clockwise a slightly greater amount than that needed to feed the print ribbon 16 a full predetermined increment. The pinion gear 24 rotates the wheel 28 counterclockwise about its axis 80. The wheel 28 rotates the drive shaft 32 counterclockwise about the axis 80. The drive shaft 32 will rotate the drive member 36, when the ribbon cartridge 18 is inserted into the printer, which will feed the print ribbon 16. The amount of the print ribbon 16 fed is controlled by the combination of the cam follower 62 and the cam profile 38.

Figure 3:
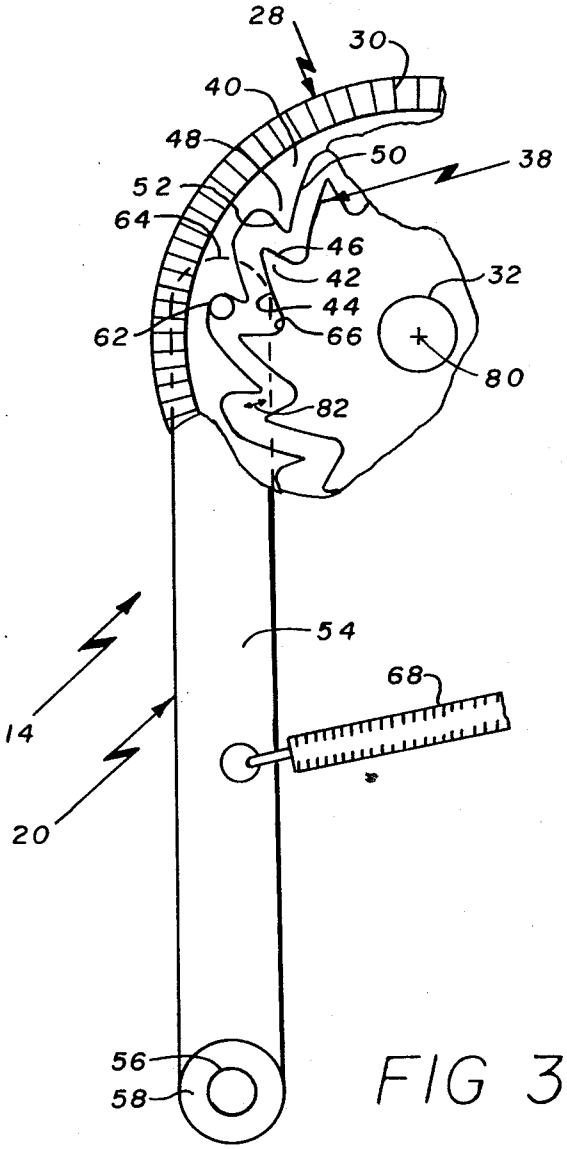
FIG. 3 is a view similar to FIG. 2 showing the cam follower in an operative position for limiting the amount of ribbon feed.

Referring now to FIGS. 2 and 3, when the wheel 28 is rotated counterclockwise by the pinion gear 24, the cam follower 62 rides along the cam surface 44 to locate the cam follower 62 in alignment with the abutment 52. The D.C. motor 22 continues to rotate the wheel 28 until the wheel 28 is stopped by the abutment 52 contacting the cam follower 62 (FIG. 3). When the cam follower 62 is seated against the abutment 52, the abutment 52 forms a locking angle relative to a path of the cam follower 62 when pivoted about the post 56. The locking angle of the abutment 52 prevents the cam follower 62 from moving out of the path of the abutment 52 whether the D.C. motor 22 remains energized or is deenergized after completion of the counterclockwise rotation of the wheel 28.

To allow the cam follower 62 to return to the rest position 66, the D.C. motor 22 is energized by a short pulse of reverse polarity to rotate the pinion gear 24 counterclockwise a slight amount. The pinion gear 24 rotates the wheel 28 clockwise a slight amount (about 8°). The clockwise rotation of the wheel 28, opposite of the ribbon feeding direction, removes the locking angle of the abutment 52 from the path of the cam follower 62. Only a low tensioned spring 68 is needed to move the cam follower 62 from the abutment 52, along a passageway 82 formed between the abutment 52 and the second working surface 46, to the rest position 66. It is desirable to have the spring 68 low tensioned to allow the rotational velocity of the wheel 28 to move the abutment 52 against the cam follower 62 instead of the cam follower 62 returning to the rest position 66 for each ribbon feed increment. A higher tensioned spring would require a higher rotational velocity of the wheel 28 which would result in an undesirable noise caused by the abutment 52 contacting the cam following 62. The low tensioned spring 68 also minimizes noise caused by the cam follower 62 returning to the rest position 66 after each ribbon feed increment.

When the cam follower 62 enters the passageway 82, the second working surface 46 contacts the cam follower 62 to prevent further clockwise rotation of the wheel 28 as the D.C. motor 22 stops rotating in the reverse direction.

After completing one ribbon feed increment and actuating another printing operation, the D.C. motor 22 will rotate the wheel 28 in the counterclockwise direction 38°. The first 8° of the 38° will take up any loss motion caused by the reverse direction of the previous feed increment and the next 30° will rotate the wheel 28 for feeding the ribbon a full feed increment.

The rubber washers 58 and 60 and an integral rubber hub (not shown) formed therebetween minimize a noise caused by the abutment 52 contacting the cam follower 62, which tends to vibrate the arm 54.

It can now be understood that limiting the amount of ribbon feed to predetermined feed increments by the cam follower 62 being responsive to the cam profile 38 provides an economical control means 20. It can now also be understood that the combination of the economical control means 20 and the D.C. motor 22 provides a low manufacturing cost and efficient ribbon feed mechanism.

What is claimed is:

1. A ribbon feed mechanism for printing machines having a ribbon mounted thereon comprising:

a motor mounted in the printing machine operable in a ribbon feed direction and in a reverse direction;

a drive member having a gear directly coupled to the motor for movement thereby in the ribbon feed direction and in the reverse direction, a shaft for feeding the ribbon in response to activation of the motor, and a cam profile integrally formed thereon having an abutment and a rest position for each feed increment;

an arm pivotable about pivot post;

a cam follower mounted on the arm for movement in an arc centered about the pivot post of the arm between the rest position and a position for contacting the abutment to simultaneously stop movement of the drive member and the motor for limiting the amount of ribbon feed to predetermined feed increments; and the abutment of the drive member having a locking angle for interfering with the arc movement of the cam follower to prevent the cam follower from returning to a rest position until the drive member has been rotated in the reverse direction by the motor.

2. The ribbon feed mechanism as defined in claim 1 wherein the cam profile includes a passageway for the cam follower to move from the abutment to the rest position when the drive member has been rotated in the reverse direction by the motor.

3. The ribbon feed mechanism as defined in claim 1 further comprises a spring operatively connected to the cam follower for biasing the cam follower from the abutment to the rest position when the drive member has been rotated in the reverse direction by the motor.

* * * * *